US007278417B2

(12) United States Patent
Ciesiun

(10) Patent No.: US 7,278,417 B2
(45) Date of Patent: Oct. 9, 2007

(54) DEVICE AND METHOD FOR ILLUMINATING LUMINESCENT PAINTBALLS

(76) Inventor: Paul M. Ciesiun, 15530 Donegal Dr., Manhattan, IL (US) 60442

( * ) Notice: Subject to any disclaimer, the term of this patent is extended or adjusted under 35 U.S.C. 154(b) by 0 days.

(21) Appl. No.: 11/331,608

(22) Filed: Jan. 14, 2006

(65) Prior Publication Data

US 2006/0112943 A1 Jun. 1, 2006

Related U.S. Application Data

(62) Division of application No. 10/461,911, filed on Jun. 13, 2003, now Pat. No. 7,040,308.

(60) Provisional application No. 60/388,534, filed on Jun. 13, 2002.

(51) Int. Cl.
*F41B 11/02* (2006.01)

(52) U.S. Cl. ..... 124/82; 124/80; 124/32; 124/71

(58) Field of Classification Search ..... 124/56, 124/1, 80, 83, 16, 21, 22, 26, 27, 82, 32, 124/71; 273/424, 425, 428
See application file for complete search history.

(56) References Cited

U.S. PATENT DOCUMENTS 1,389,132 A * 8/1921 Galavan ..... 362/101
1,693,368 A * 11/1928 Cherry ..... 43/113
2,113,409 A * 4/1938 Niemeyer ..... 43/113
3,059,373 A * 10/1962 Gardner ..... 43/113
5,311,413 A * 5/1994 Farmer et al. ..... 362/154
5,415,151 A * 5/1995 Fusi et al. ..... 124/56
5,762,058 A * 6/1998 Cheng et al. ..... 124/56
6,048,280 A * 4/2000 Palmer et al. ..... 473/416
6,082,349 A * 7/2000 Cheng et al. ..... 124/56
6,134,826 A * 10/2000 Mah ..... 43/112
6,298,841 B1 * 10/2001 Cheng et al. ..... 124/56

* cited by examiner

*Primary Examiner*—Troy Chambers
(74) *Attorney, Agent, or Firm*—Cherskov & Flaynik

(57) ABSTRACT

A device 10 for illuminating luminescent paintballs before the paintballs are projected down the barrel of a paintball gun includes a conduit 12 configured to form a forty-five degree angle to promote the arranging of luminescent paintballs into a single row as the paintballs "fall" from an enclosure and into the conduit 12 to ultimately exit the conduit 12 and drop into a discharge mechanism, a plurality of ultraviolet lamps 14 that are positioned about an inner portion of the conduit 12 to illuminate the luminescent paintballs thereby urging the paintballs to "glow" in the dark, a "horseshoe" configured bracket 16 that disposes the lamps 14 at preselected portions of the conduit 12 that maximizes the exposure of the paintballs to ultraviolet light from the lamps 14, a low voltage D.C. battery 18 and on-off switch 20 attached to an outer portion of the conduit 12, and an inverter 22 also attached to an outer portion of the conduit 12 adjacent to the battery 18, the battery 18, on-off switch 20 and inverter 22 cooperating to provide a stepped up R.M.S. voltage to the lamps 14.

A hoper device 50 for illuminating luminescent paintballs before the paintballs are projected down the barrel of a paintball gun includes a hopper shell 52, top and bottom rows 54 and 56 of ultraviolet lights 14 disposed at preselected portions of the shell 52 to maximize the exposure of the paintballs 11 to ultraviolet light emitted from the lights 14, a pair of low voltage D.C. batteries 58 that supply power via a switch 60 to an inverter 62 which increases the voltage to a magnitude used by the lights 14.

22 Claims, 18 Drawing Sheets

DEVICE AND METHOD FOR ILLUMINATING LUMINESCENT PAINTBALLS

This application is a Divisional Application of prior application Ser. No. 10/461,911, filed on Jun. 13, 2003, now U.S. Pat. No. 7,040,308 which claims benefit of 60/388,534 filed on Jun. 13, 2002.

BACKGROUND OF THE INVENTION

1. Field of the Invention

The present invention relates to a game and/or sport of paintball conducted in low light or dark conditions ("night paintball") and more particularly, to a device that illuminates a luminescent paintball before being projected from a paintball "gun" thereby allowing a contest without illuminating the field of play that the players are competing upon.

2. Background of the Prior Art

Paintball is a fast growing game played mainly outdoors during daylight hours upon large areas of natural terrain or indoors upon artificial terrain. The object of the game is to strike an opposing player (commonly identified via an armband with corresponding markings) with a paintball projected from a specially designed "gun." The paintball includes a soft outer shell that collapses upon striking a targeted player thereby releasing an internal fluid or paint that adheres to and identifies the player as being "hit" which relegates him to observer status in a neutral zone for the remainder of the game.

To identify a player as being hit during a low light or night paintball game, the paint must be luminescent or capable of "glowing in the dark" for a predetermined period of time after the paintball strikes the targeted player thereby marking him or her. Further, the "glow" must cease in a relatively short period of time to prevent "hits" from being counted by a referee during a subsequent paintball game. The glowing paintball provides a visual display similar to tracer bullets shot from a gun during a firefight thereby enhancing the entertainment, visual, safety, accuracy and fair play aspects of night paintball.

Prior methods of charging luminescent paintballs have used a relatively large ultraviolet light (black light) in close proximity to a plurality of paintballs prior to being placed into a hopper or container to be ultimately used with a paintball gun on a field of play. The problem with this method is that relatively long periods of time are required to adequately "charge" the light "absorbing" particles throughout the luminescent paintballs to thereby cause the paintballs to glow sufficiently. Another problem with the method is that the light intensity of the charged paintballs start attenuating immediately upon being removed from the black light, resulting in the paintball being barely visible in flight when loaded and "shot" from a projecting mechanism (paintball gun). Yet another problem with this method is a relatively long time delay between the paintball's exposure to the ultraviolet light and the projection of the paintball from the gun. This time delay causes the glow to dissipate such that the luminescent paint is not visible when splattered upon an opposing player.

Another prior method of charging luminescent paintballs is described in U.S. Pat. No. 6,082,349 wherein a high voltage element is utilized to power a flash tube which is triggered to activate a phosphorescent ball as the ball is discharged through a tube in the paintball gun. The problem with this device is that expensive, complex and relatively fragile electronic and potentially dangerous power circuits are used to control and power a multitude of components that illuminate the phosphorescent balls.

A need exists for a mechanically rugged charging device and/or method that inexpensively and safely charges a phosphorescent paintball while the ball is stored in a portion of a paintball gun disassociated with the gun's discharge mechanism. Also, the device and/or method may include components that de-energize ultraviolet lighting that may be exposed to the human eye when a participant places paintballs in a hopper portion of a paintball gun. Further, the device and/or method must sufficiently charge the paintball such that upon being "shot" from the gun, the paintball will provide a luminous trail until engaging a target, whereupon the luminescent paint will continue to emit a luminous pattern for a predetermined time after being disposed upon the target surface.

SUMMARY OF THE INVENTION

It is an object of the present invention to overcome many of the disadvantages associated with illuminating phosphorescent fluids or paint in paintballs used for night paintball games.

A principle object of the present invention is to provide a device that illuminates luminescent paintballs before the balls are urged into a discharge mechanism of a paintball "gun"; the conduit portion ultimately directing the paintballs into a discharge mechanism in the gun. A feature of the device is a modified conduit that includes a plurality of ultraviolet lamps inserted therein. An advantage of the device is that the paintballs are orientated into a single row for maximum exposure to the ultraviolet lamps before being projected from the paintball gun resulting in paintballs that provide a bright, visible glow after being projected from the gun thereby facilitating a luminous trail or "tracer effect" for enhanced safety, fair play and entertainment during the paintball contest.

Another principle object of the present invention is to provide a device that illuminates large quantities of luminescent paintballs while in a container and before the balls are projected down the barrel of a paintball gun. A feature of the device is a hopper that includes a plurality of ultraviolet lamps disposed about an inner portion of the hopper. An advantage of the device is that a large quantity of paintballs are continuously exposed to ultraviolet light resulting in light emanating from the paintballs after being projected from a paintball gun thereby facilitating a luminous trail or "tracer effect" for enhanced visual entertainment and shooting accuracy, and further facilitating target marking. Another advantage of the device is that the enclosed paintballs "share" ultraviolet light between adjacent glowing paintballs while exposed to the ultraviolet light source and after the ultraviolet light has been removed.

Another object of the present invention is to provide a device that disposes the ultraviolet lamps about an inner portion of a conduit. A feature of the device is a bracket configured to cooperate with the periphery of the conduit. An advantage of the device is that the lamps are quickly positioned about the conduit by the bracket.

Yet another object of the present invention is to provide a device that allows the lamps to insert into the conduit. A feature of the device is a plurality of apertures through predetermined portions of the conduit. An advantage of the device is that the lamps are disposed in close proximity to the paintballs thereby receiving a relatively large quantity of ultraviolet light.

Another object of the present invention is to provide a device that prevents engagement between the ultraviolet lamps inserted into the conduit and the paintballs. A feature of the device is a guard member disposed adjacent to each lamp. An advantage of the device is that the guard member is configured to protect the lamp while allowing the paintball to move unobstructedly through the conduit and past the lamp.

Another object of the present invention is to provide a device that is safe for an operator of a paintball gun. A feature of the device is a low power source for energizing all the ultraviolet lights. An advantage of the device is that a night paintball contestant does not have to wear protective equipment to avoid electric shock when participating in a night paintball game.

Another object of the present invention is to provide a device that is relatively inexpensive. A feature of the device is the small quantity of electrical components utilized to light activate the phosphorescent paintballs. An advantage of the device is that day paintball participants can play night paintball for substantially the same costs by incorporating the device into standard daytime paintball equipment.

Another object of the present invention is to provide a device that is mechanically durable when exposed to extreme movements. A feature of the device is the ability of the electrical components to withstand mechanical vibrations. An advantage of the device is a decrease in failure rates for charging luminescent paintballs.

Another object of the present invention is to provide a device that promotes the enclosing of all electrical components. A feature of the device is small electrical components and ultraviolet lights. An advantage of the device is the prevention of physical contact between the electrical components and an opponent's projected paintballs. Another advantage is that expensive sensory devices are eliminated. Yet another advantage of the device is that the paintball gun's weight distribution is improved along with "shooting" accuracy by not placing "charging" equipment on the paintball gun barrel.

Briefly, the invention provides a device for illuminating luminescent paintballs before the balls are projected down the barrel of a paintball gun comprising paintball containment means; means for illuminating the luminescent paintballs while disposed in said containment means; means for disposing said illuminating means at preselected portions of said containment means; and means for energizing said illuminating means whereby the luminescent paintballs provide a tracer effect when the luminescent paintballs are discharged from a paintball gun.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
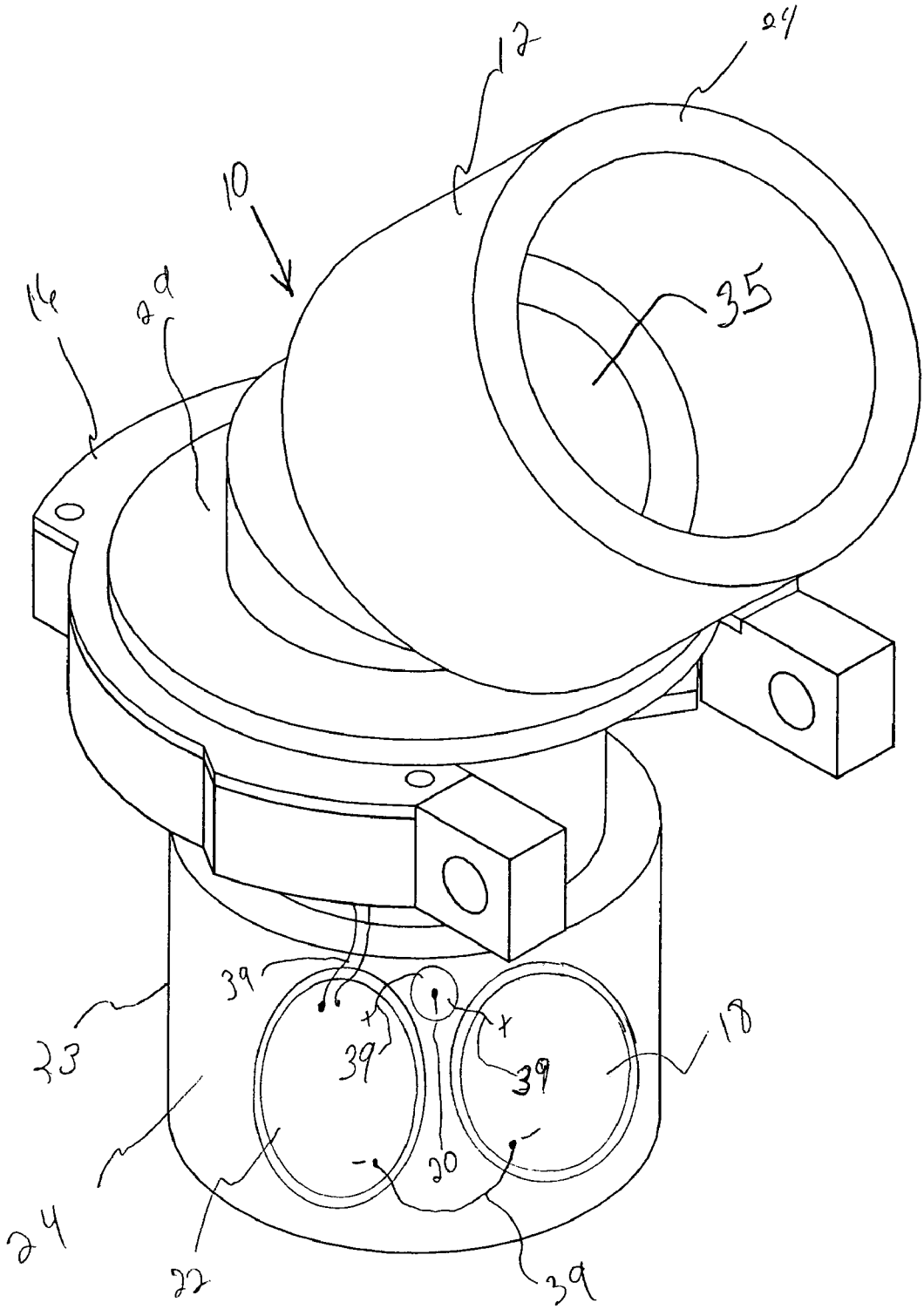
FIG. 1 is a perspective view of a device for illuminating luminescent paintballs while disposed in a conduit portion of a paintball discharge mechanism in accordance with the present invention.
Figure 2:
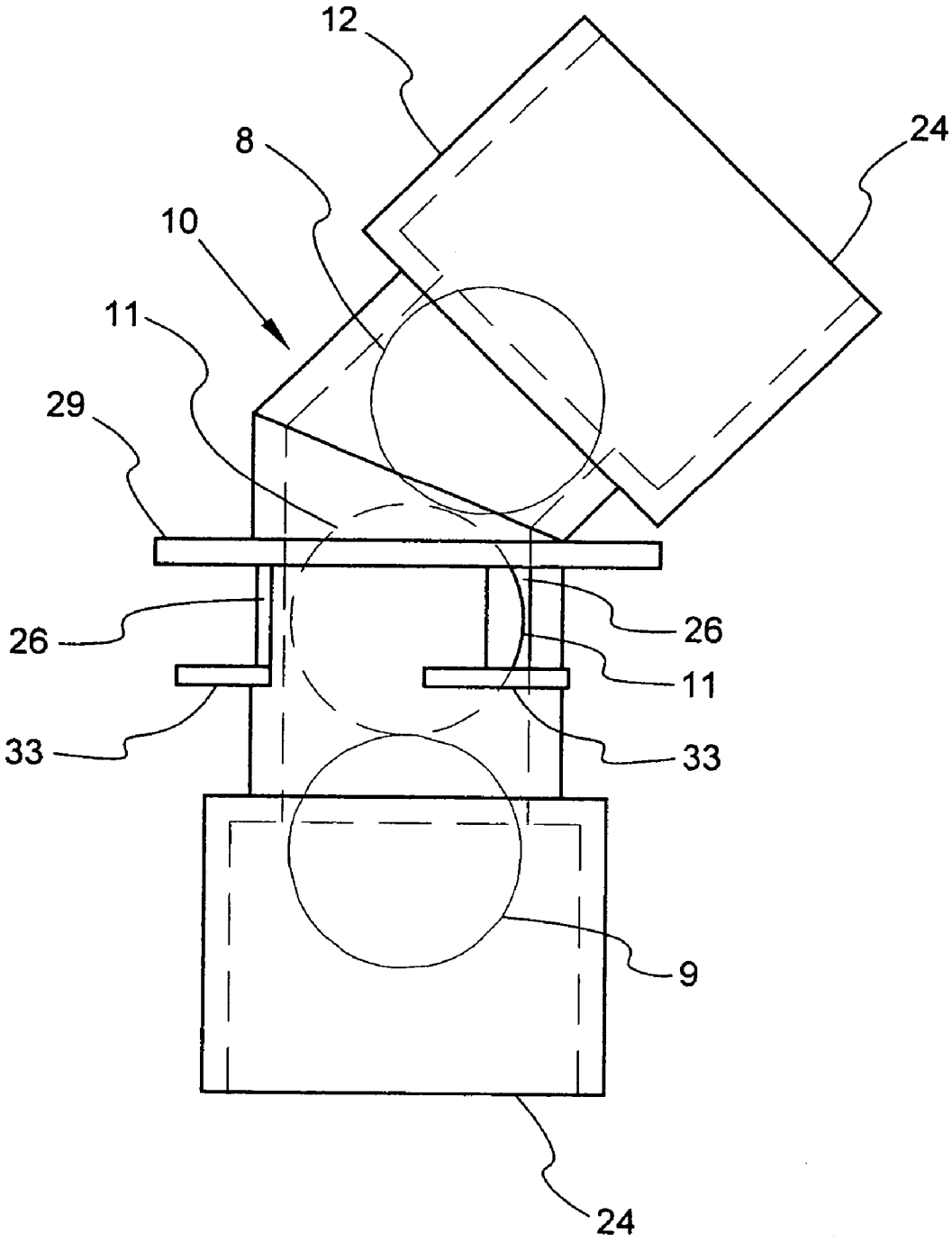
FIG. 2 is a side elevation view of FIG. 1, but with a horseshoe configured bracket removed and phantom luminescent paintballs added.
Figure 3:
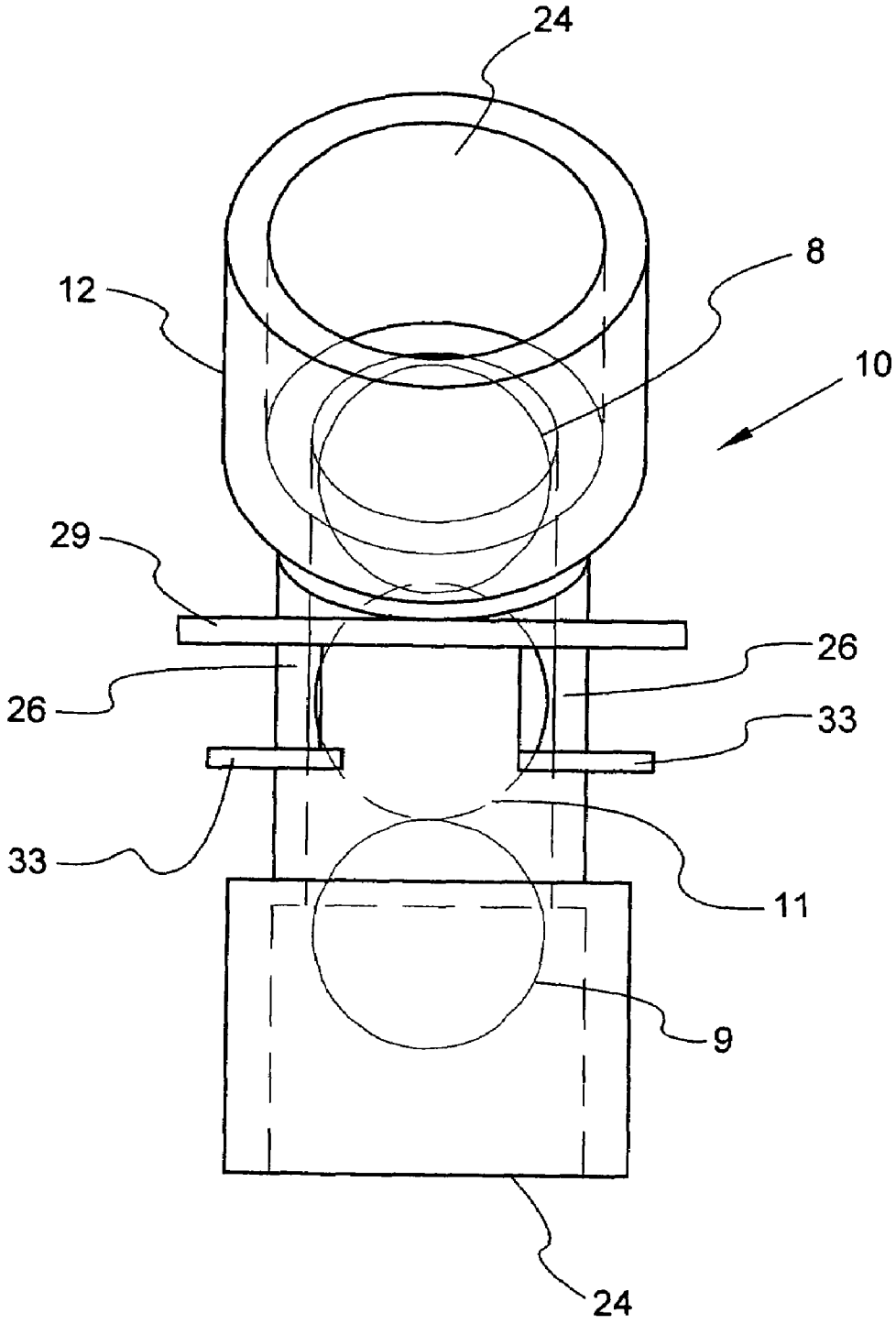
FIG. 3 is a front elevation view of FIG. 2.
Figure 4:
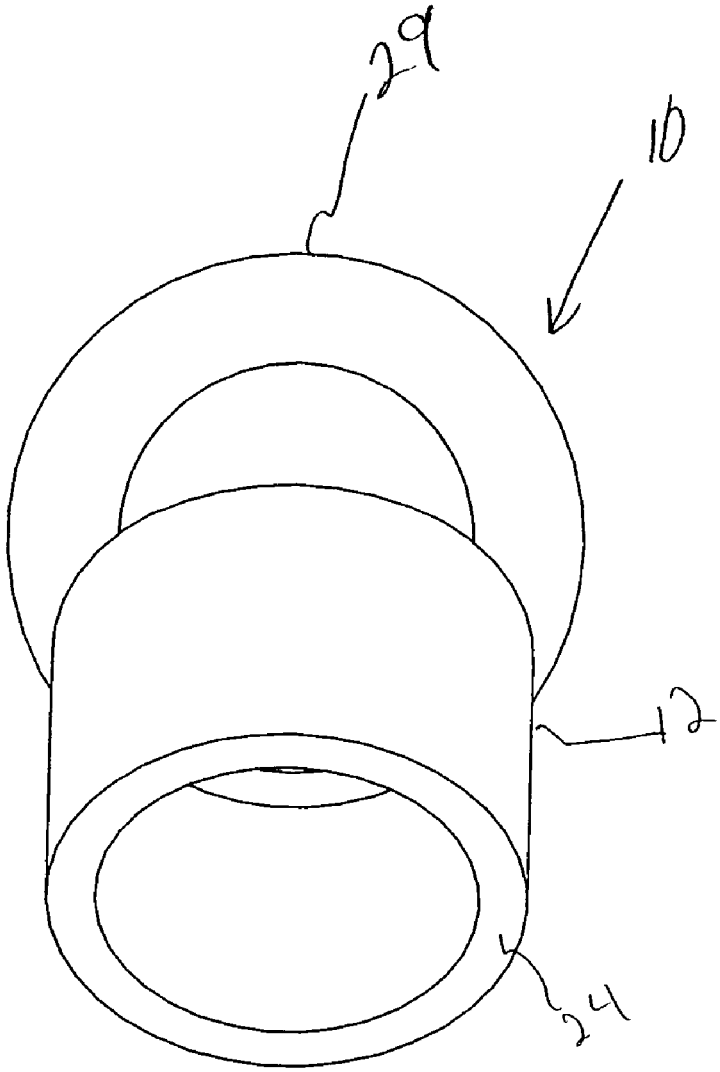
FIG. 4 is a top elevation view of FIG. 2.
Figure 5:
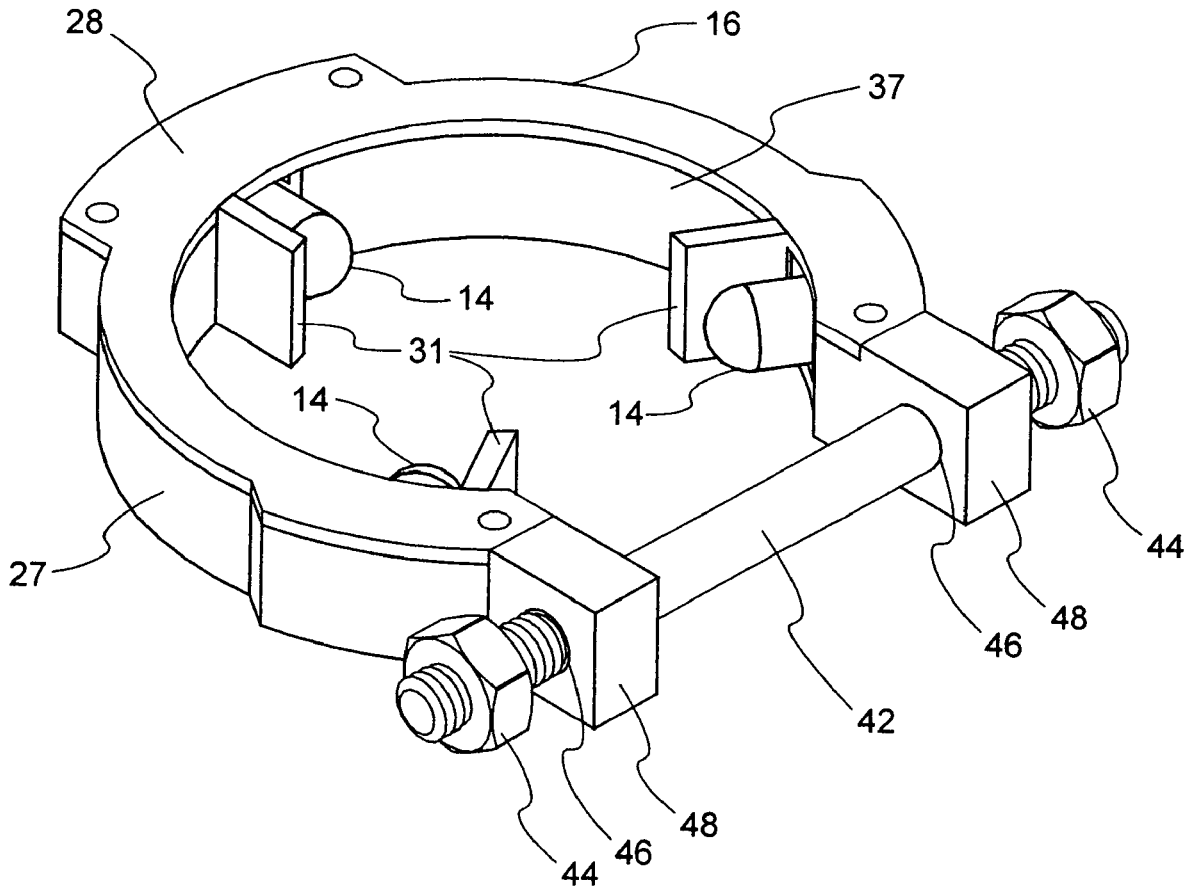
FIG. 5 is a perspective view of a bracket member of the device of FIG. 1 in accordance with the present invention.
Figure 6:
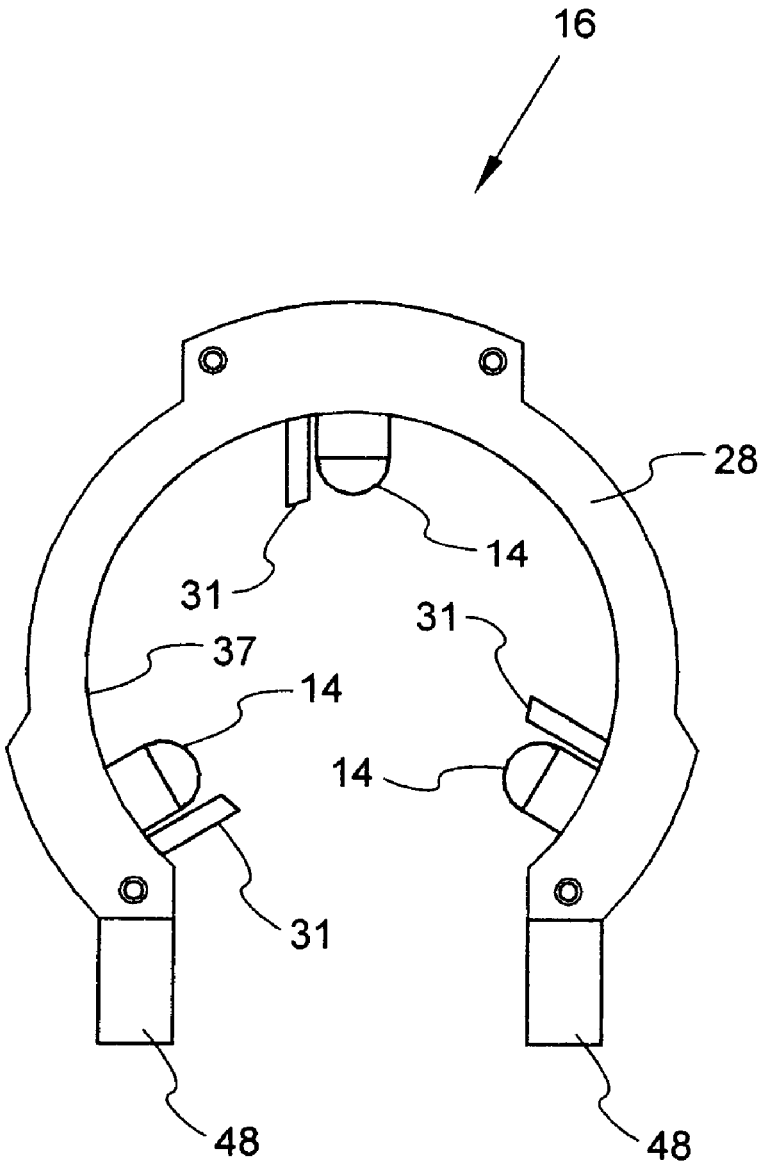
FIG. 6 is top view of the bracket member of FIG. 5.
Figure 7:
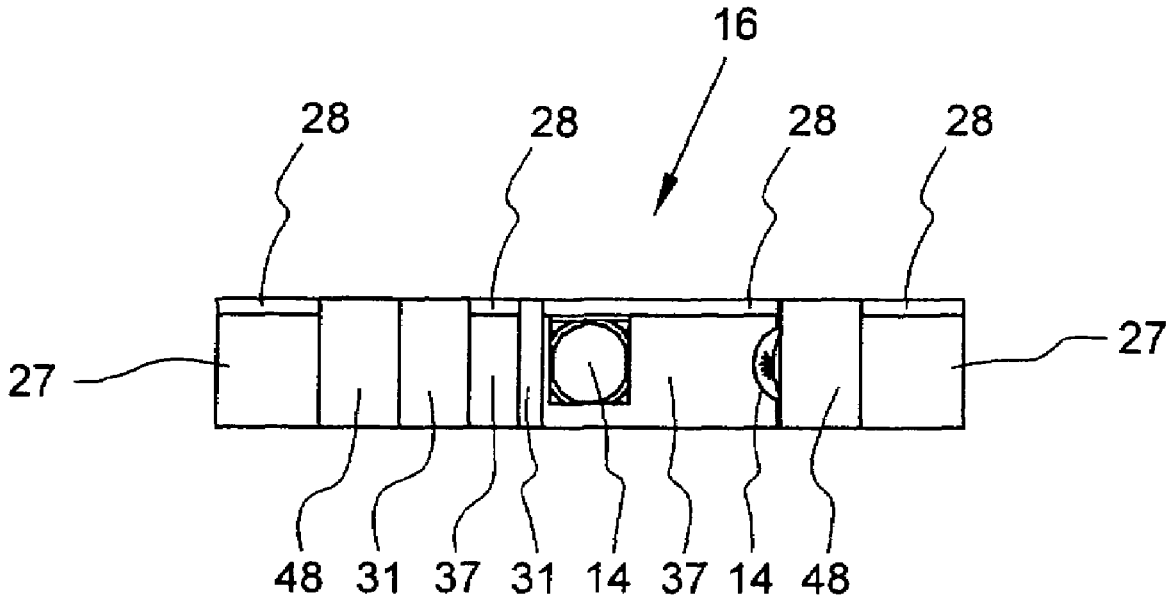
FIG. 7 is a front elevation view of the bracket member of FIG. 5.
Figure 8:
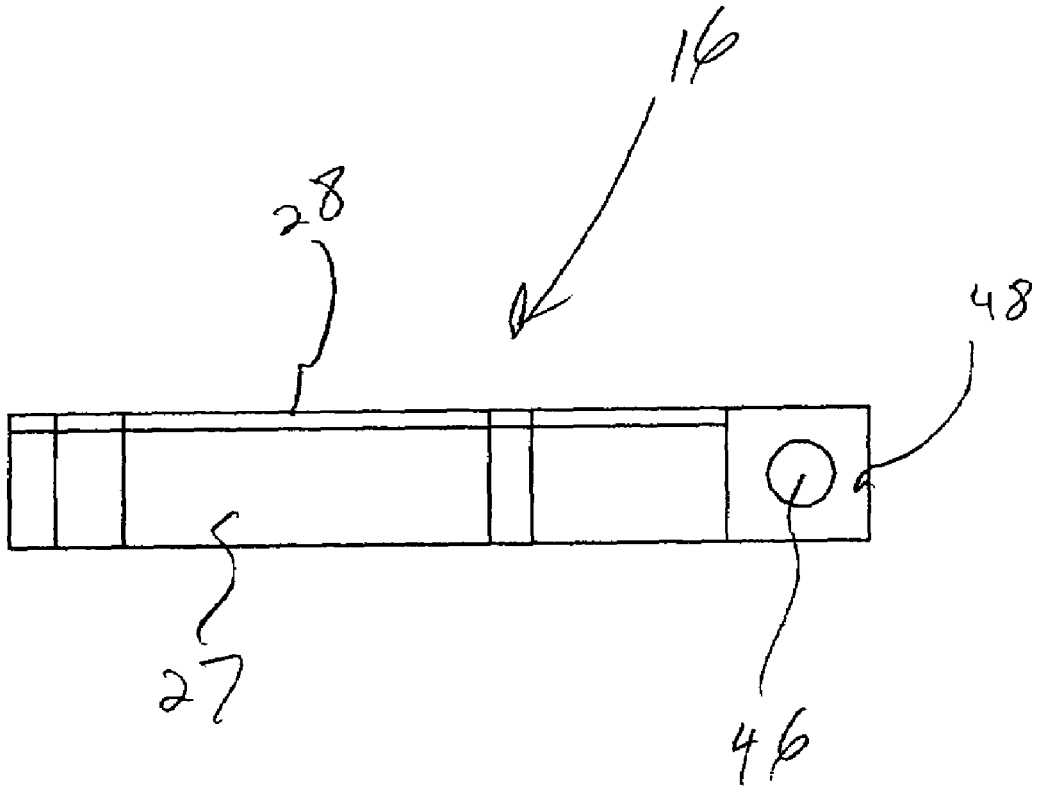
FIG. 8 is a side elevation view of the bracket member of FIG. 5.
Figure 9:
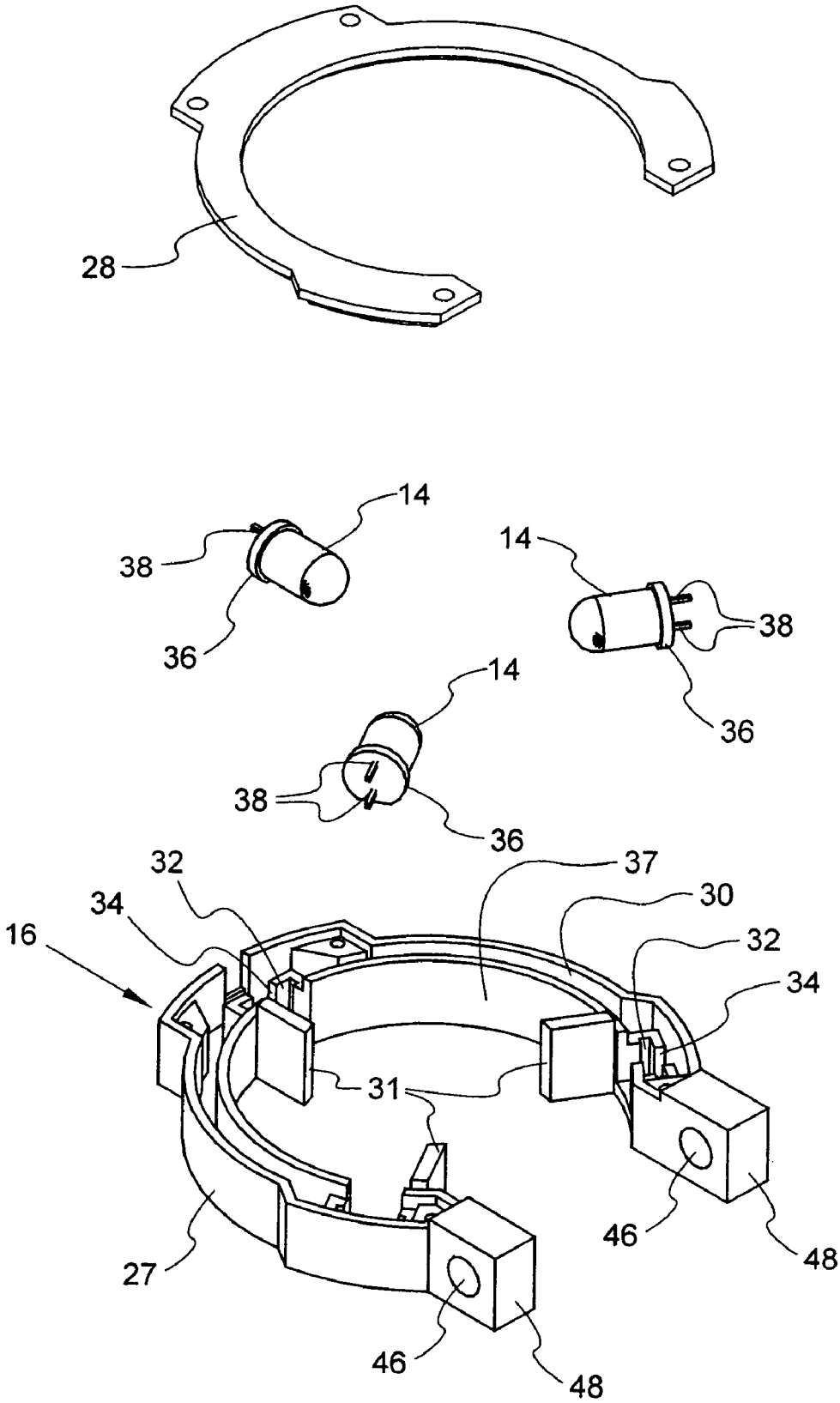
FIG. 9 is an exploded perspective view of the bracket member of FIG. 5.

Referring now to the drawings and in particular to FIGS. 1-9, a device for illuminating luminescent paintballs 11 before the balls are urged into a discharge mechanism (not shown) of a paintball gun (not pictured) is denoted by numeral 10. The paintball device 10 includes a conduit 12 configured to form proximately a forty-five degree angle to promote the substitution of the present device 10 with a conduit portion of a typical paintball gun. Although the conduit 12 is depicted as being "bent," alternative configurations including vertical and horizontal may be utilized. The device 10 further includes a plurality of ultraviolet lamps 14 disposed about an inner portion of the conduit 12 to illuminate or "charge" the luminescent paintballs thereby causing the paintballs to "glow" in the dark; a "horseshoe" configured bracket 16 that disposes the lamps 14 at preselected portions of the conduit 12 to maximizes the exposure of the paintballs to ultraviolet light from the lamps 14; and a low voltage D.C. battery 18, an on-off switch 20 and an inverter 22 adjacently disposed and attached to an outer wall 23 of the conduit 12; the battery 18, on-off switch 20 and inverter 22 cooperating to provide a stepped up R.M.S. voltage to the lamps 14.

Referring to FIGS. 1-4, the conduit 12 is fabricated from plastic or metal and includes enlarged end portions 24 that snugly receive cooperating portions 86 of a hopper 50 (see FIG. 14) and a discharge mechanism (not shown) of a typical paintball gun. The conduit 12 has three apertures 26 radially disposed and spaced apart substantially equal distances about a mid-portion of the conduit 12 to receive corresponding ultraviolet lamps 14 and guard members 31 thereby facilitating the insertion of the lamps 14 and guard members 31 into the interior of the conduit 12 to ultimately position the lamps 14 adjacent to the paintballs 11 for maximum ultraviolet light exposure as the paintballs 11 move through the conduit 12. Although three lamps 14 is the preferred configuration of the present invention, a greater or lesser quantity of lamps having a myriad of configurations 14 may be used so long as the paintballs 11 are exposed to ultraviolet light of substantially the same intensity and time period such that the tracer effect generated by a projected paintball is visible to night paintball participants. Further, added lamps 14 may be disposed in the paintball guns projection chamber or in the breech of the gun should increased exposure to ultraviolet lighting be required to provide a more intense luminous trail.

The conduit 12 further includes an annular plate 29 circumferentially disposed above the apertures 26 to engage and provide stability to the bracket 16 when the bracket 16 is secured to the conduit 12. The bracket 16 is further stabilized by a plurality of arcuate support members 33 disposed beneath the bracket 16 to engage and maintain the position of the bracket 16 relative to the conduit 12. Three guard members 31 (FIGS. 5 and 6) are disposed adjacent to corresponding lamps 14 and integrally joined to a inner cylindrical wall 37 of the bracket 16 to protect the lamps 14 by reducing the number of "collisions" between the lamps 14 and the paintballs without obstructing movement of the paintballs 11 through the conduit 14. The inner cylindrical wall 35 of the conduit 14 is coated with reflective material such as chrome paint or light reflective plastic to reflect and maintain ultraviolet light inside the conduit to better activate the luminescent material inside the paintballs 11 thereby inducing the paintballs 11 to generate more light.

Referring to FIGS. 5-9, the horseshoe configured bracket 16 includes a channel portion 27 and a removable top potion 28 that covers a wire channel 30 in the channel portion 27. The bracket 16 is configured to cooperate with the periphery of the conduit 12 thereby allowing a myriad of bracket 16 configurations to be utilized to position the lamps 14. The lamps 14 are forcibly secured to the channel portion 27 via base and connector slots 32 and 34 cooperating with corresponding base and connector portions 36 and 38 of the lamps 14. The base slot 32 snugly receives the base portion 36 of the lamp 14 after vertically aligning the connector portions 38 of the lamps 14 with the connector slot 34. Wires 39 routed through the channel 30 ultimately connect to the connector portions 38 such that the lamps 14 are wired "in parallel" thereby maintaining illumination of functioning lamps 14 in the event that one or more lamps 14 should fail. Guard members 31 integrally joined to the inner cylindrical wall 37 of the channel portion 27 and disposed adjacent to the lamps 14, are dimensioned to snugly insert into corresponding apertures 26 in the conduit 12 to maintain the position of the bracket 16 relative to the conduit 12 during operation of the paintball 11 discharge mechanism. The bracket 16 is ultimately secured to the conduit 12 by a retaining bolt 42 and nuts 44 inserted through apertures 46 in cooperating opposing end portions 48 separated a predetermined distance that allows the bracket 16 to removably receive the conduit, the end portions 48 ultimately being detachably joined together.

Figure 10:
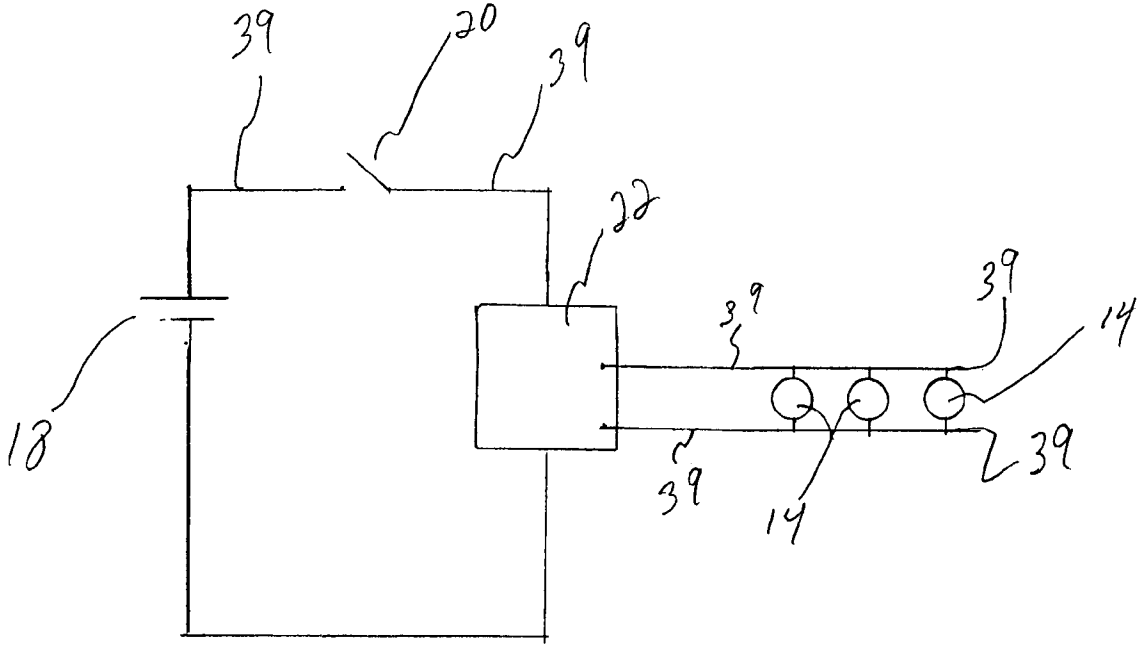
FIG. 10 is a schematic diagram of electrical components of the device in accordance with the present invention.
Figure 11:
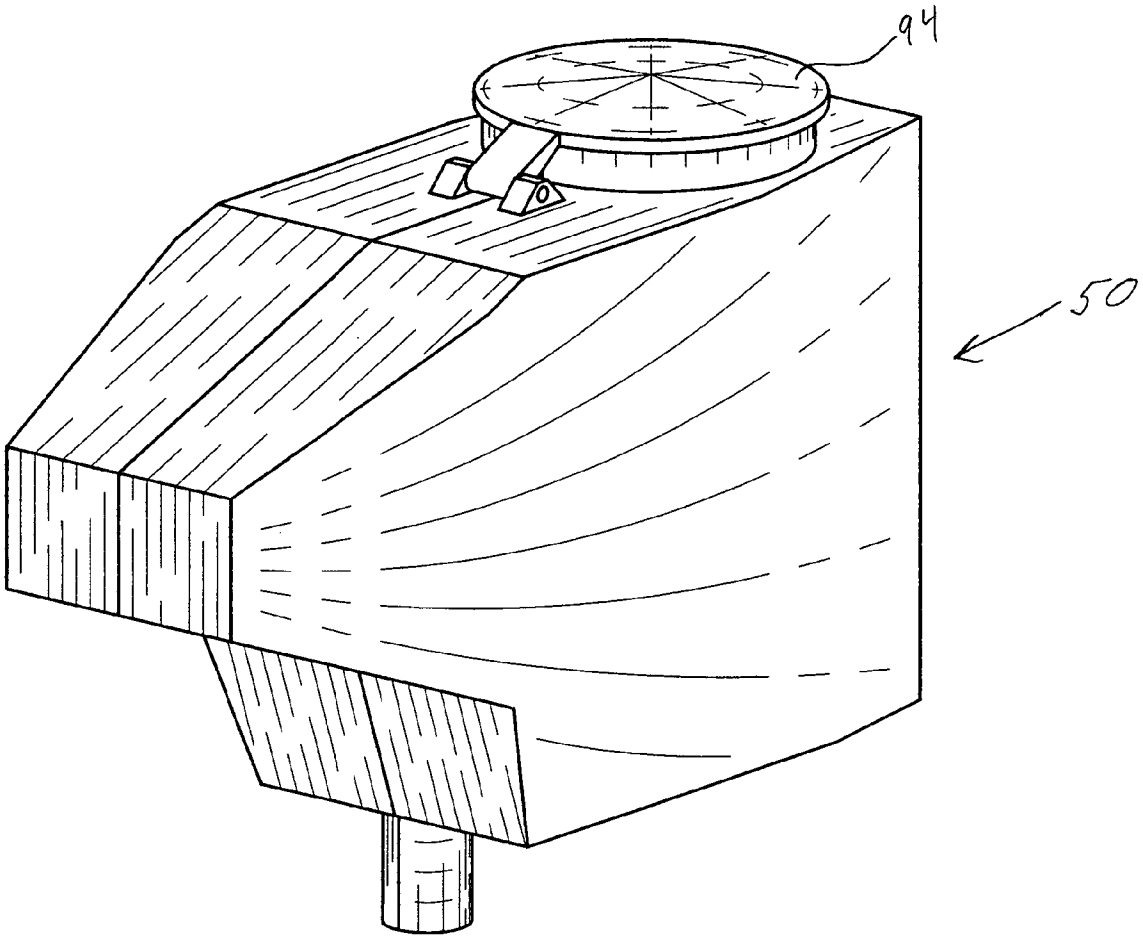
FIG. 11 is a perspective view of a hopper portion of a paintball discharge mechanism, the hopper portion containing luminescent paintballs that are ultimately exposed to illuminating means that "charge" the luminescent paintballs while disposed in the hopper in accordance with the present invention.

The lamps 14 may be ultraviolet light emitting diodes or cold cathode ultraviolet lights or similar ultraviolet lights capable of providing light intensity comparable to that of a 50 millimeter long, 3 millimeter diameter narrow spectrum miniature ultraviolet cold cathode flourescent lamp, model BF 350-UV1, manufactured by JKL Components Corporation of 13343 Paxton St., Pacoima Calif., 91331. The lamps 14 are illuminated via a 650 volt R.M.S. output from an inverter-power supply 22 manufactured by JKL Components Corporation. The power input to the inverter 22 is provided by one or more 3 volt lithium batteries 18 secured to the conduit 12. Power to the battery 18 and inverter 22 is ultimately controlled via a micro toggle switch 20 well known to those of ordinary skill in the art (see FIG. 10). Although ultraviolet lights are the preferred components for illuminating the paintballs 11, alternative lighting elements for charging the paintballs 11 include high intensity mercury vapor and halogen.

In operation, the device 10 replaces the conduit portion of a daytime paintball gun thereby retrofitting the daytime paintball gun for night paintball usage. Alternatively, the device 10 is included in the manufacturing process of a paintball gun specifically built for night paintball. The night paintball gun includes a hopper or similar paintball storage member that receives a plurality of luminescent paintballs 11 that are urged via gravity or assist feeds from the hopper into the conduit 12 of the device 10 to form a single line of paintballs 11. The conduit 12 may also be used to extend the charging time for paintballs that have been initially exposed to ultraviolet lighting inside the hopper before being urged into the conduit 12. This is an important feature during periods when paintballs are not being "shot." Once the paintballs drop into the conduit 12, the toggle switch 20 is positioned to provide power from the battery 18 to the inverter 22 thereby energizing the lamps 14 and engulfing the paintballs 11 in the conduit 12 with ultraviolet light. The paintballs 11 become luminous or "glow" after a few seconds of exposure to the ultraviolet light whereupon a first paintball 9 drops from the conduit 12 into a discharge mechanism and a hopper paintball 8 drops into the conduit 12.

The hopper paintball 11 is activated by the ultraviolet light while the first paintball 11 is projected through a barrel portion of the paintball gun and provides a luminous trail visible to paintball participants in the field of play. The exposure time of the paintball 11 to ultraviolet light in the conduit 12 (about ten seconds) is such that the paintball 11 provides not only a luminous trail, but also a luminous paint pattern on a target after an outer shell of the paintball 11 ruptures upon striking the target. The luminous paint pattern continues glowing for several minutes after impact to allow sufficient time for field judges to inspect for "hits" between opposing teams of paintball participants.

Referring now to FIGS. 11-17, a hopper device for illuminating luminescent paintballs 11 before the balls 11 are urged into a discharge mechanism of a paintball gun (not shown) is denoted by numeral 50. The hopper device 50 includes a typical hopper shell 52 well known to those of ordinary skill in the art, top and bottom rows 54 and 56 of ultraviolet lights 14 disposed at preselected portions of the shell 52 to maximize the exposure of the paintballs 11 to ultraviolet light emitted from the lights 14, a pair of low voltage D.C. batteries 58 that supply power via an "on-off" micromini toggle switch 60 to an invertor 62 which increases the voltage to a magnitude utilized by the lights 14. A myriad of hopper device 50 configurations may be utilized for night paintball. The optimum placement of ultraviolet lights 14 to illuminate paintballs 11 within the chosen hopper configuration is determined via trial and error.

The hopper shell 52 includes an inner wall 64 coated in an aluminum or chrome paint or plastic to create a mirrored or highly reflective interior that promotes reflected ultraviolet light within the shell 52 thereby engulfing all inner portions of the shell 52 and all luminescent paintballs 11 therein with ultraviolet light that activates the paint inside the paintballs 11 causing the balls 11 to glow in relatively dark playing conditions. The hopper shell 52 may be one of a myriad of configurations well known in the industry for day paintball contests, or may be a new design specifically formed for uniformly distributing ultraviolet light throughout the internal cavity of the hopper shell 52.

The hopper shell 52 further includes battery and inverter chambers 66 and 68 to house and protect the batteries 58 and inverter 62 from inclement weather and paintballs 11 fired from "enemy" participants. The shell 52 and chambers 66 and 68 are fabricated from plastic or comparable lightweight, durable material, and configured by joining two similar half-portions manufactured via a dye and mold process well known in the industry. The chambers 66 and 68 may be integrally fabricated with the shell 52, or may be fabricated as discrete components and secured to the shell 52 via setscrews. The batteries 58 and inverter 62 are mounted inside the respective chambers 66 and 68 via screws, clamps, adhesives or similar securing elements commonly used in the industry. Removable panels 70 and 72 provide access to the battery and inverter chambers 66 and 68, respectively. The inverter chamber panel 72 includes apertures that allow the toggle switch 60, which is secured to the inverter 62, and a "power on" light 74 to protrude through the panel 72 and interact with the user of the hopper device 50.

Figure 13:
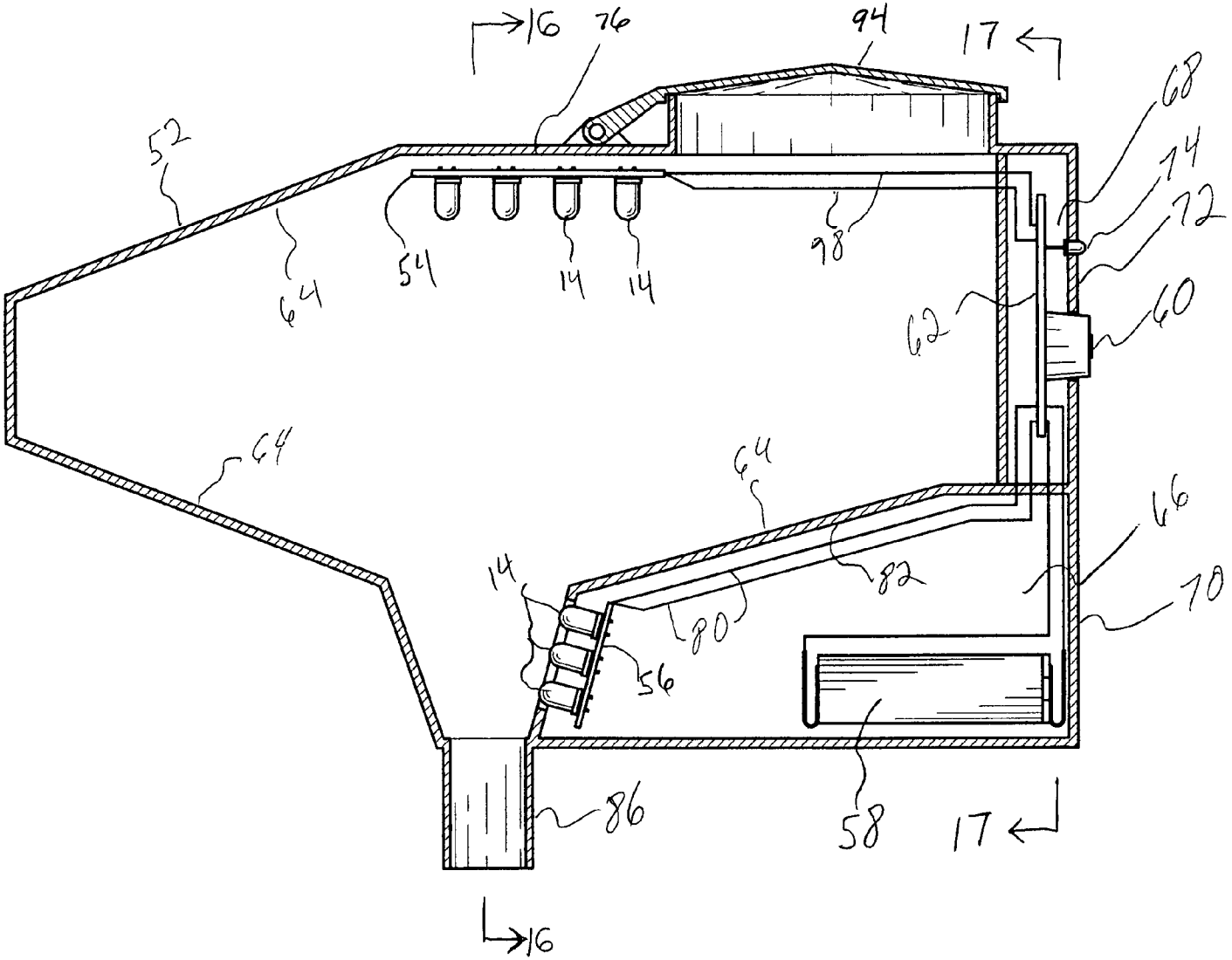
FIG. 13 is a side elevation view of the hopper portion of FIG. 10 with no paintballs contained therein.
Figure 14:
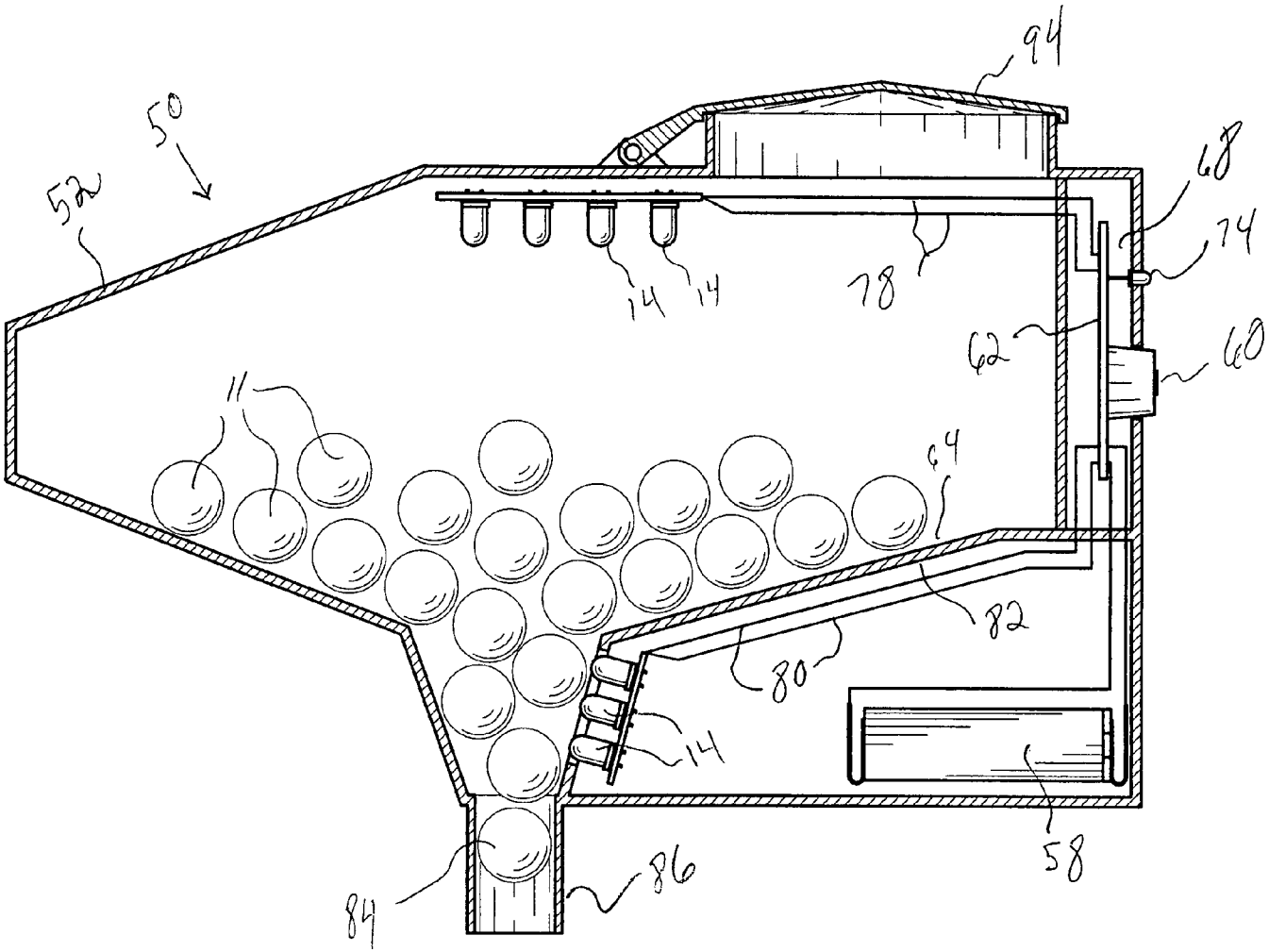
FIG. 14 is the same side elevation view depicted in FIG. 12, but with a plurality of paintballs contained therein.
Figure 15:
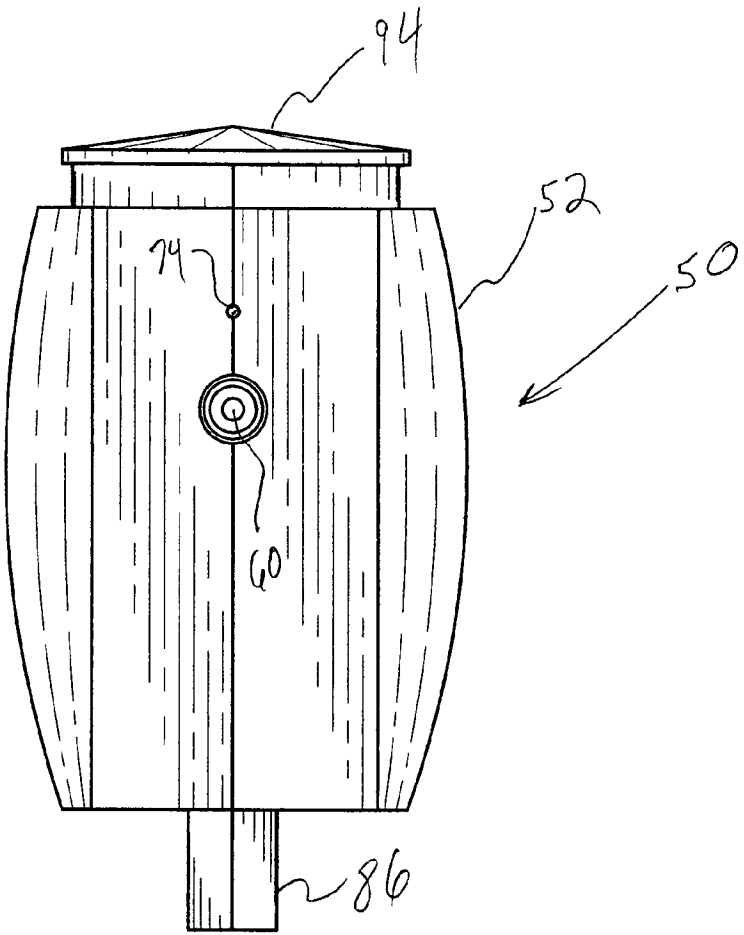
FIG. 15 is a back elevation view of the hopper portion of FIG. 10.
Figure 16:
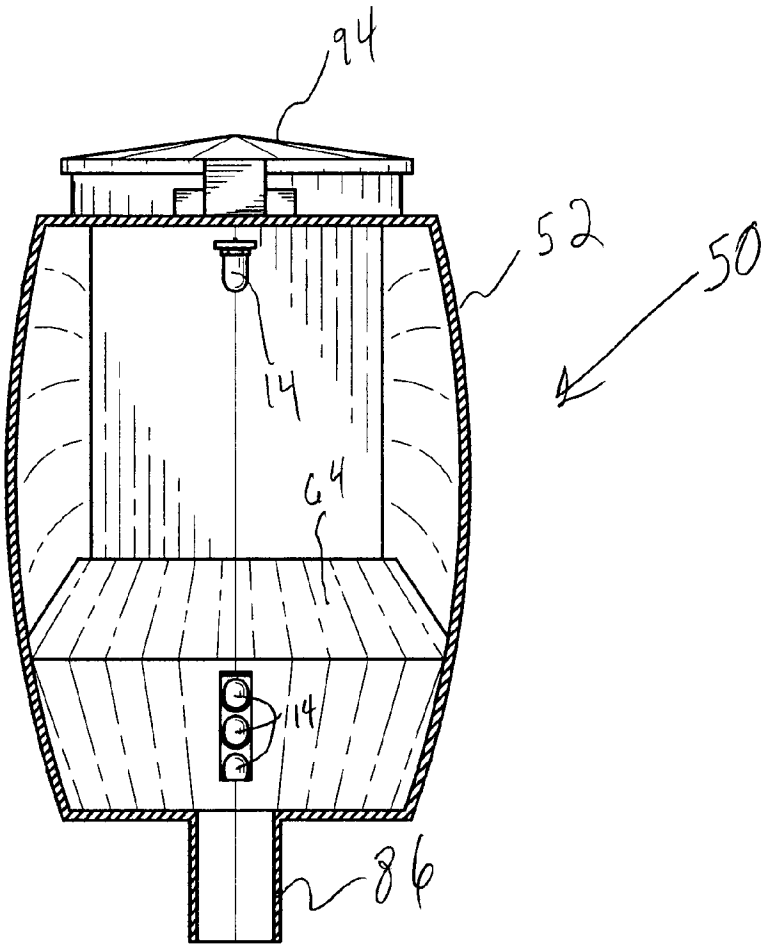
FIG. 16 is a sectional view of the hopper portion taken along line 16-16 of FIG. 12.
Figure 17:
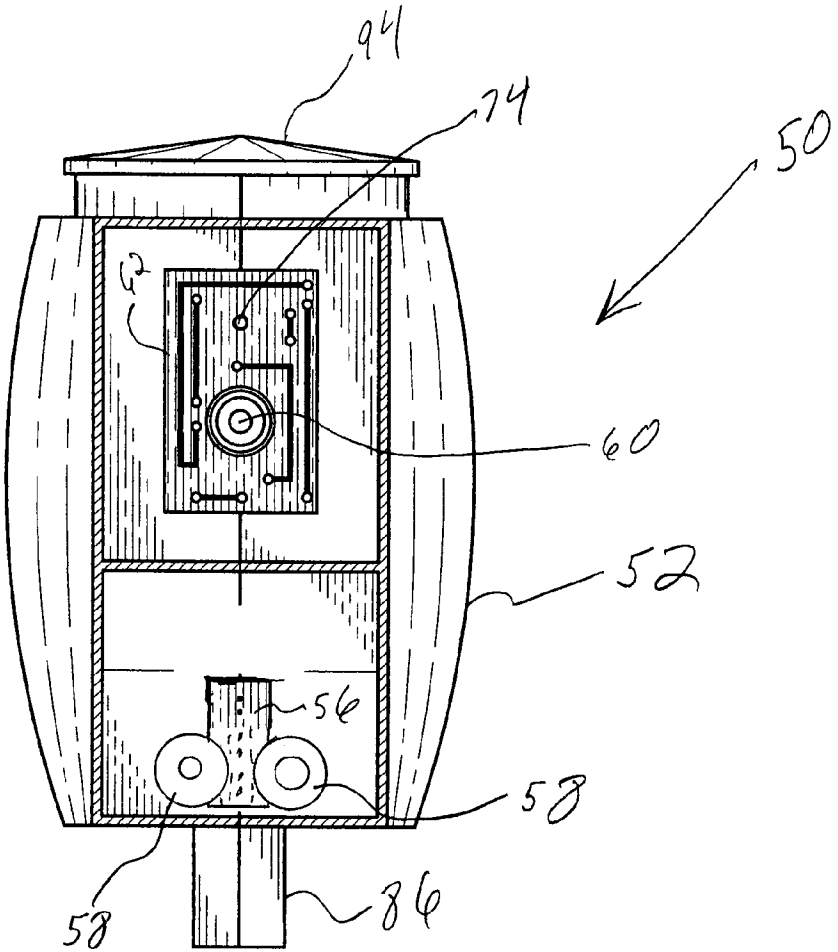
FIG. 17 is a sectional view of the hopper portion taken along line 17-17 of FIG. 12.

The ultraviolet lights 14 are required to provide about a three-hundred and sixty-five nanometer wavelength, although shorter or longer wavelengths will cause the paintballs 11 to glow with less intensity. Suitable ultraviolet lights 14 have a part number BF 350-UV1 and are manufactured by JKL Components Corporation of St. Paceima Calif. Alternatively, light emitting diodes (LED's) may be used so long as the ultraviolet light specifications are maintained. The top row 54 of lights 14 are secured to the inner wall 64 of the shell 52 via set screw or similar joining elements. The lights 14 of the top row 54 may be orientated in a direction opposite to the top portion 76 as depicted in FIGS. 13 and 14, or the lights 14 may be orientated such that each light 14 of the top row 54 is directed toward a different internal portion of the shell 52 resulting in a more uniform illumination of all the paintballs 11 inside the shell 52 and causing the paintballs 11 to glow at a constant intensity. The lights 14 in the top row 54 are energized via wires 78 secured to a top portion of the inner wall 64 of the shell 52 and connected to the inverter 62.

The bottom row 56 of ultraviolet lights 14 are secured to a bottom portion of the shell 52 such that an end portion of the lights 14 insert into cooperating apertures whereby the lights 14 illuminate but do not engage the paintballs 11 as the paintballs are gravity fed into the discharge mechanism of the paintball gun. The lights 14 in the bottom row 56 are energized via wires 80 secured to a battery chamber wall 82 and connected the inverter 62. The placement of the wires 80 in the battery chamber 66 prevents the wires from obstructing movement of paintballs 11 from the hopper device 50 to a discharge mechanism, standard conduit or the conduit 12 of the illuminating device 10 detailed above. The wiring scheme for the batteries 58, toggle switch 60, inverter 62 and power on light 74 is depicted in FIG. 18.

When operating a paintball gun during night paintball with a hopper device 50 but without including the conduit device 10 detailed above, a relatively large quantity of luminescent paintballs 11 are illuminated simultaneously with ultraviolet light by disposing the paintballs 11 inside a hopper device 50 having ultraviolet or similar high intensity lighting therein. The paintballs 11 substantially fill the typical hopper shell 52 of a paintball gun (see FIG. 14). A toggle switch 60 is positioned to energize and illuminate top and bottom rows 54 and 56 of ultraviolet lights 14. As the paintball gun begins to discharge paintballs 11, the first projected paintball 84 will glow very little due to the paintball 84 being disposed in a discharge port 86 or conduit where little ultraviolet light will reach. As more paintballs 11 are discharged, the glow intensity increases resulting in a visible tracer effect for the paintball participants. When the paintballs 11 strike a target, the outer shell ruptures allowing the glowing paint therein to spread upon the target and assist a judge or referee during a night paintball game to acknowledge a "hit" by the "shooter" of the luminescent paintball 11.

Professional night paintball games may require all luminescent paintballs 11 discharged from a paintball gun to glow sufficiently to allow a referee to record a hit upon an opposing participant. To illuminate the paintballs 84 in the discharge port 86 or in the conduit of a typical paintball gun, the above described illumination device 10 which includes a conduit 12 should be combined with the hopper device 50 thereby providing ultraviolet light to all luminescent paintballs 11 before the balls 11 are urged or dropped into the discharge mechanism of a paintball gun.

Figure 12:
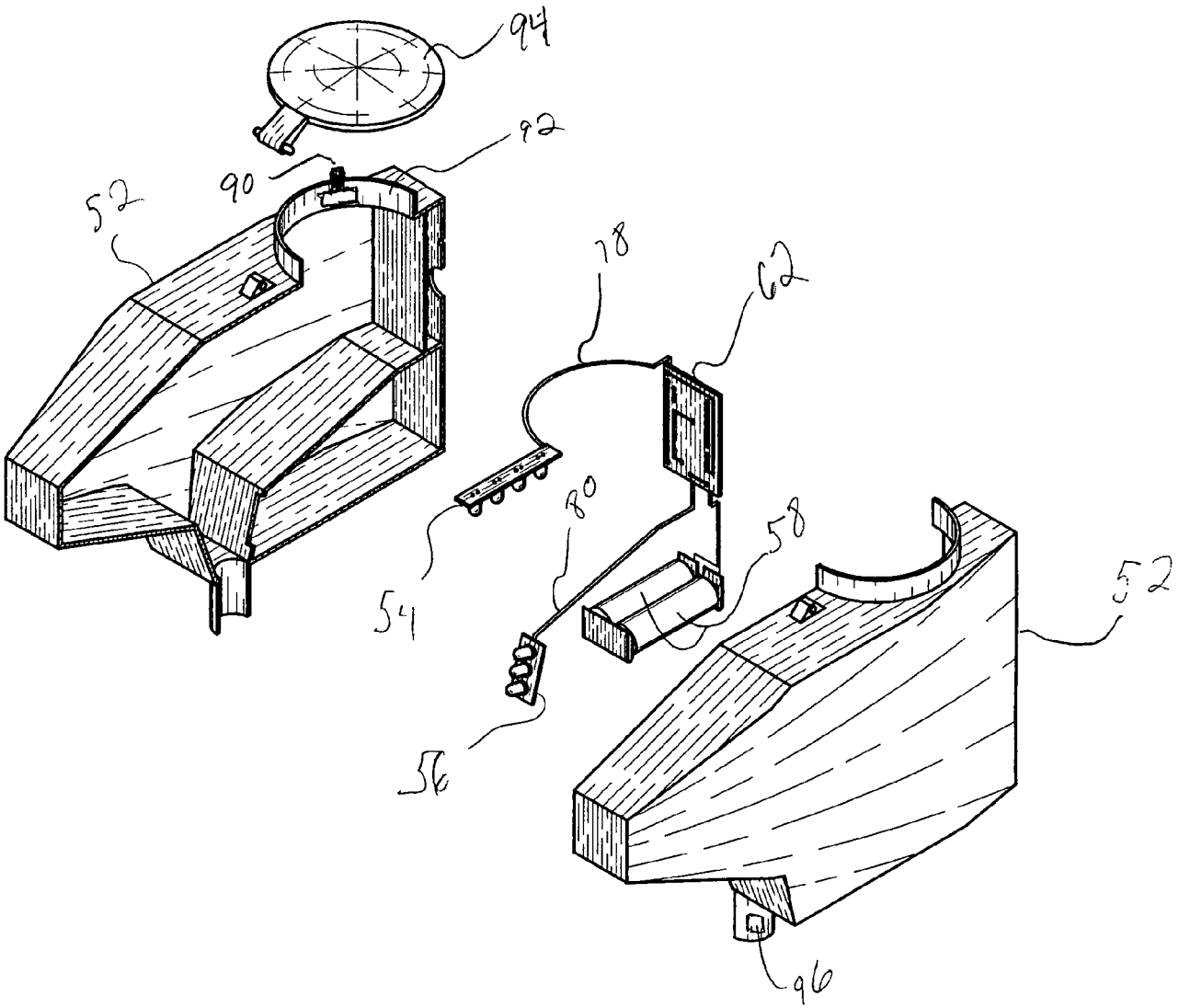
FIG. 12 is an exploded perspective view of the hopper portion of FIG. 10.
Figure 18:
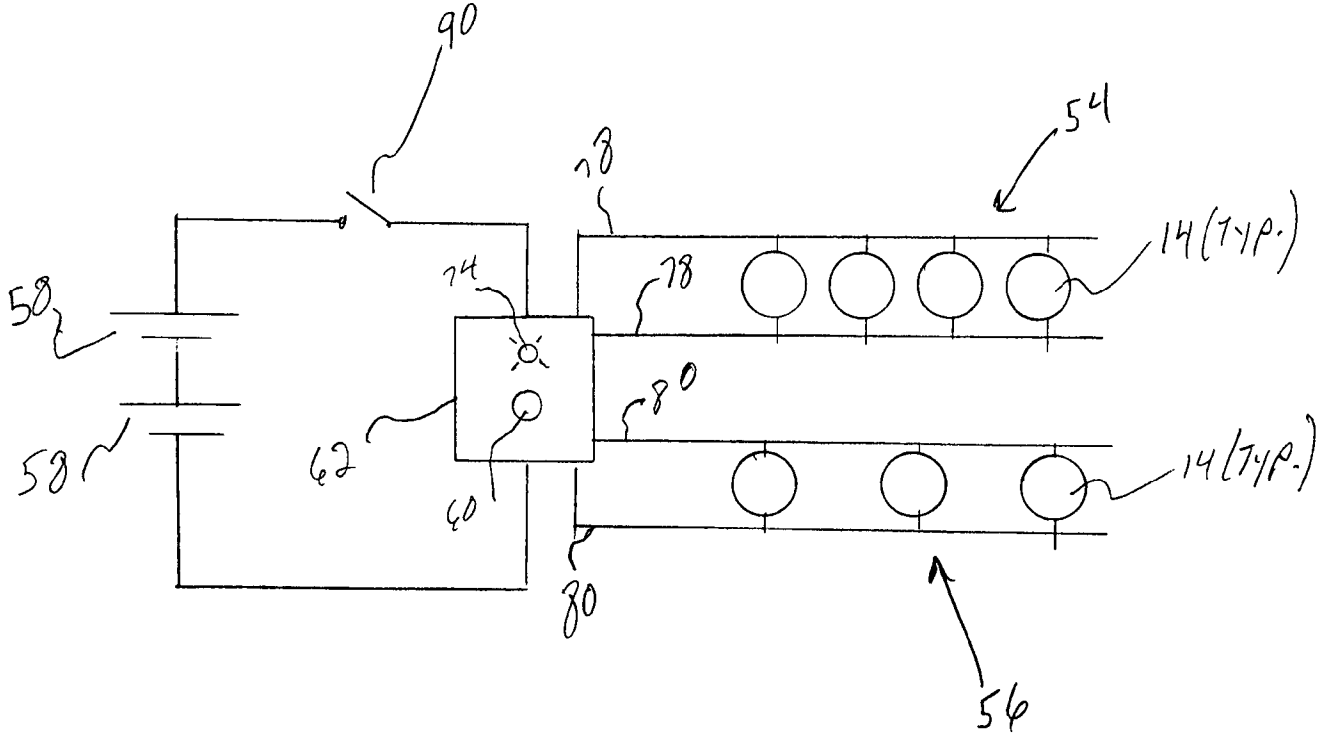
FIG. 18 is a schematic diagram of electrical components of a hopper device in accordance with the present invention.

Referring now to FIGS. 12 and 18, an on-off switch 90 may be secured to the rim portion 92 of the hopper shell 52 such that when the lid 94 is lifted off the switch 90 and rim 92, the switch 90 opens the circuit from the batteries 58 to the inverter 62 and de-energizes the ultraviolet lights 14 thereby preventing a user's eyes from being exposed to ultraviolet light when filling the hopper shell 52. Continued exposure to ultraviolet light can be detrimental to the vision of some players. Although the manually activated switch 60 on the inverter 62 can be positioned to cut-off power, a player will sometimes forget to turn off the power to the ultraviolet lights 14 when filling the shell 52. Along with adding a switch 90 to the device 50, a viewing window 96 may be added to the discharge port 86 to allow a user to determine if paintballs need to be added to the device 50.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A paintball gun, comprising: a device for illuminating luminescent paintballs in said paintball gun before the paintballs are projected down the barrel of said gun, said device comprising:

a conduit having a first end disposed to receive non-illuminated paintballs from a predetermined portion of said paintball gun, said conduit having a second end disposed to provide illuminated paintballs to a predetermined portion of said paintball gun;

means for illuminating the luminescent paintballs while the paintballs are disposed inside said conduit; and means for energizing said illuminating means whereby luminescent paintballs exiting said second end of said conduit emit light that ultimately provides a luminous trail when the luminescent paintballs are discharged from the barrel of said paintball gun.

2. The device of claim 1 wherein said conduit is dimensioned to orientate the paintballs into a single row.

3. A paintball gun, comprising: a device for illuminating luminescent paintballs in said paintball gun before the paintballs are projected from said paintball gun, said device comprising:

paintball containment means, said containment means including a conduit having a first end disposed to receive non-illuminated paintballs, said conduit having a second end disposed to provide illuminated paintballs for projection from said paintball gun, said conduit including an elbow dimensioned to provide paintballs in a single row when exiting said elbow;

means for illuminating the luminescent paintballs while the paintballs are disposed in said containment means;

means for disposing said illuminating means at preselected portions of said containment means; and means for energizing said illuminating means whereby the luminescent paintballs provide a tracer effect when the luminescent paintballs are discharged from said paintball gun.

4. The device of claim 1 wherein said illuminating means includes at least one ultraviolet light disposed in said conduit to illuminate the paintballs after being orientated in a single row.

5. The device of claim 1 wherein said illuminating means includes a plurality of ultraviolet lights disposed to illuminate the luminescent paintballs at predetermined positions.

6. The device of claim 5 wherein said illuminating means includes three ultraviolet lights disposed to illuminate the luminescent paintballs while in said conduit.

7. The device of claim 5 wherein said plurality of ultraviolet lights are equally spaced about said conduit.

8. The device of claim 5 wherein said plurality of ultraviolet light are radially disposed about said conduit.

9. The device of claim 1 wherein said illuminating means includes a bracket configured to allow said bracket to engage and be secured to said conduit.

10. The device of claim 9 wherein said bracket includes two opposing ends separated a predetermined distance that allows said bracket to removably receive said conduit, said opposing ends ultimately being detachably joined together.

11. The device of claim 10 wherein said bracket includes ultraviolet lights that provide light at about a three-hundred and sixty-five nanometer wavelength.

12. The device of claim 9 wherein said bracket includes at least one aperture configured to receive one of said ultraviolet lights therethrough.

13. The device of claim 9 wherein said bracket includes means for securing said illuminating means to said bracket.

14. The device of claim 13 wherein said securing means includes a slot that allows a predetermined portion of said illuminating means to snugly and slidably insert therein to maintain the position of said illuminating means relative to said bracket.

15. The device of claim 9 wherein said bracket includes a channel to removably receive a plurality of electrical conductors that ultimately connect to said illuminating means and said energizing means.

16. The device of claim 9 wherein said bracket includes a guard member integrally joined to an inner cylindrical wall, said guard member being disposed adjacent to said illuminating means to prevent engagement between said illuminating means and the paintballs.

17. The device of claim 16 wherein said guard member cooperates with a corresponding aperture in said conduit to maintain the position of said bracket relative to said conduit during operation of said paintball gun.

18. The device of claim 16 wherein said guard member is disposed adjacent to each ultraviolet light secured to said bracket.

19. The device of claim 18 wherein each of said guard members member is configured and dimensioned to prevent engagement between said illuminating means and the paintballs without obstructing movement of the paintballs through said conduit.

20. The device of claim 1 wherein said energizing means includes at least one battery connected to said illuminating means to continuously illuminate the paintballs while an electrical switch is in an "on" position.

21. The device of claim 1 wherein said conduit includes an internal reflective coating to reflect ultraviolet light within said conduit, thereby engulfing the paintballs with ultraviolet light.

22. A method for modifying a paintball gun to discharge illuminated luminescent paintballs, said method comprising the steps of:

installing a conduit to receive non-illuminated paintballs and to provide illuminated paintballs to a predetermined portion of said paintball gun;

directing luminescent paintballs through said conduit; and illuminating the luminescent paintballs while inside said conduit whereby paintballs exiting said conduit emit light that ultimately provides a luminous trail when the paintballs are discharged from said paintball gun.

* * * * *